US005732575A

United States Patent [19]

Kaveney

[11] Patent Number: 5,732,575

[45] Date of Patent: Mar. 31, 1998

[54] HASP TYPE LATCH

[75] Inventor: John R. Kaveney, East Peoria, Ill.

[73] Assignee: Caterpillar Inc., Peoria, Ill.

[21] Appl. No.: 728,867

[22] Filed: Oct. 10, 1996

[51] Int. Cl.[6] ..... E05B 65/48; H01H 9/28

[52] U.S. Cl. ..... 70/2; 16/321; 16/337; 70/6; 70/DIG. 30; 200/43.16; 292/281

[58] Field of Search ..... 70/DIG. 30, 2–13; 292/281; 200/43.16, 43.14, 43.22, 43.01; 16/321, 337

[56] References Cited

U.S. PATENT DOCUMENTS

| | | | |
|---|---|---|---|
| 542,518 | 7/1895 | Cashin | 70/13 |
| 653,141 | 7/1900 | Johnson | 70/5 |
| 959,234 | 5/1910 | Larkin | 70/4 |
| 1,307,253 | 6/1919 | Griffith | 70/DIG. 30 |
| 1,525,799 | 2/1925 | Christie | 70/11 |
| 1,801,228 | 4/1931 | Edhlund | 200/43.22 X |
| 5,558,209 | 9/1996 | Mohsen | 200/43.16 X |

*Primary Examiner*—Lloyd A. Gall
*Attorney, Agent, or Firm*—Mario J. Donato, Jr.

[57] ABSTRACT

A closure fastener comprising a hasp assembly pivotally connected to a staple assembly. The hasp assembly includes a latch arm having an aperture adjacent its free end. The staple assembly includes a staple having an aperture disposed transversely therethrough providing a passage for a shackle of a lock, the staple being received by and extending through the latch arm aperture when the latch arm is in a closed position. A base member is integrally connected to the staple and has an aperture therethrough for receiving a switch engagement member of a disconnect switch. A stud is integrally connected to the base member, the stud having an aperture disposed transversely therethrough. A pivot pin in disposed through the stud aperture and through a pivot pin receiving aperture of the latch arm, thereby pivotally connecting the hasp assembly to the staple assembly.

9 Claims, 2 Drawing Sheets

HASP TYPE LATCH

TECHNICAL FIELD

This invention relates generally to closure fasteners, and more particularly, to, a hasp-type latch for preventing access to a battery disconnect switch on a machine.

BACKGROUND ART

Latches of the hasp type have been widely employed in connection with industrial doors, gates and various other structures where a relatively strong, but relatively low cost latching assembly is desired to retain a door gate in a closed position. Frequently such hasp type latches will include a staple with a formed wire element providing a U-shaped structure which is intended to receive the shackle of a keylock or combination lock to hold the latch arm in a position therebelow and against the staple base. In addition, hasp-type latches have been used on lockouts to equipment such as electrical switches, circuit breakers, fuse boxes, etc. One problem associated with hasp-type latches, particularly ones utilizing a hasp and a cooperating staple, is that when not in use, the hasp moves freely to extend transversely from its respective mounting surface and the staple extends rigidly from its respective mounting surface, both of which present potential harm to persons in the proximity of the same.

The present invention is directed to overcoming or more of the problems set forth above.

DISCLOSURE OF THE INVENTION

The present invention is directed toward an apparatus for preventing access to a battery disconnect switch on a machine. The invention includes a hasp assembly, the hasp assembly including a latch arm having a proximal end and a distal end, the latch arm being movable between an open position and a closed position. The latch arm has an aperture therethrough adjacent its distal end. A staple assembly is pivotally attached to the hasp assembly and includes a base plate having a proximal end and a distal end, the base plate having a disconnect switch aperture disposed therethrough. The staple assembly further includes a staple extending upwardly from the base plate, the staple being connected to the base plate adjacent the base plate distal end. The staple is received by and extends through the aperture of the latch arm when the latch arm is in the closed position. A stud is connected to the base plate adjacent the base plate proximal end. The stud extends upwardly from the base plate, the stud having a pivot pin disposed transversely therethrough, the pivot pin being disposed transversely through the latch arm proximal end, thereby pivotally connecting the hasp assembly to the staple assembly.

These and other aspects and advantages of the present invention will become apparent upon reading the detailed description of the preferred embodiment in connection with the drawings and appended claims.

BRIEF DESCRIPTION OF THE DRAWINGS

For a better understanding of the present invention, reference may be made to the accompanying drawings, in which.

DESCRIPTION OF A PREFERRED EMBODIMENT OF THE INVENTION

Figure 1:
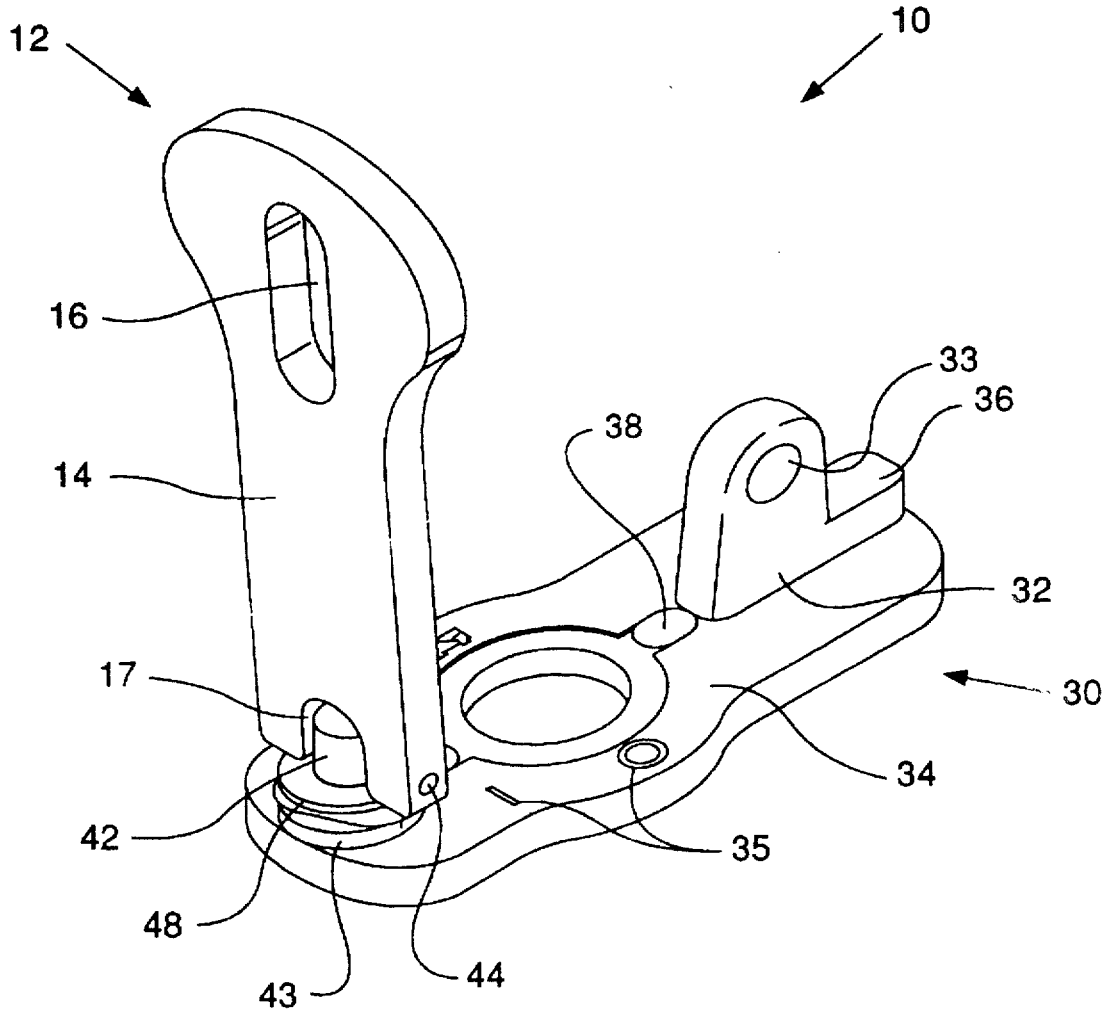
FIG. 1 is a perspective view of a hasp-type latch in accordance with the present invention, wherein the latch arm is in the open position.
Figure 2:
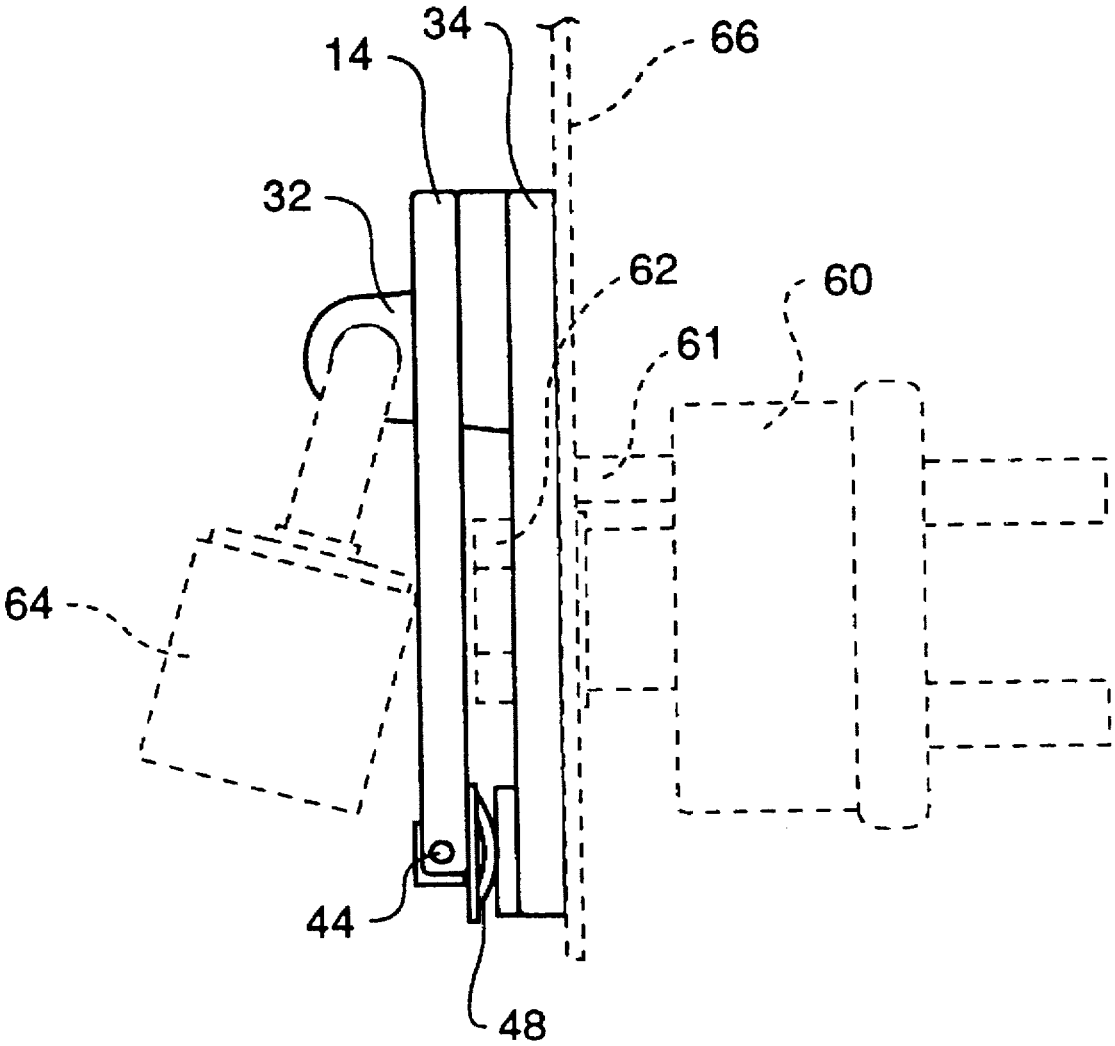
FIG. 2 is a side elevational view thereof, and further including a mounting panel, a disconnect switch, and a padlock, all shown in phantom.

Referring now to the drawings, a closure fastener is designated generally by reference numeral 10. The fastener 10 comprises a hasp assembly 12 and a cooperating staple assembly 30. The hasp assembly 12 includes an elongated latch arm 14 moveable between an open position and a closed position, the latch arm 14 having a staple receiving aperture 16 adjacent its free end. The staple assembly 30 includes a staple 32, a base plate 34 integrally attached to staple 32, and a stud 42 integrally attached to base plate The latch arm 14 is a substantially planar member having a staple receiving aperture 16 longitudinally disposed in a locking end thereof, the locking end being located opposite a pivotal end. The staple receiving aperture 16 facilitates in receiving the staple 32 therethrough when the hasp assembly 12 and staple assembly 30 are cooperatively engaging one another (i.e. when the latch arm is in the closed position).

The staple assembly 30 is pivotally attached to hasp assembly 12, and includes a staple 32 integrally attached to base plate 34. The staple 32 includes an aperture 33 disposed transversely therethrough, the aperture 33 providing a passage for a shackle of a lock 64. The base plate 34 is adapted to be mounted on a support surface such as a mounting panel 66. A disconnect switch 60 is disposed on one side of mounting panel 66, with the closure fastener 10 being disposed on the other side. A switch engagement member 62, such as a toggle lever or a key lock mechanism, protrudes through mounting panel 66 and through a switch engagement member aperture, which is disposed through base plate 34. Base plate 34 further includes a pin locator aperture 38 which receives disconnect switch pin 61. Disconnect switch pin 61 is connected to disconnect switch 60, such that when disconnect switch pin 61 is received by pin locator aperture 38, disconnect switch 60 is aligned with base plate 34, thereby ensuring that the base plate indicia 35, which indicate an on, an off, and a battery disconnect state, respectively, of disconnect switch 60, are in the proper position.

A stud 42 is integrally formed with a stud pedestal 43, which is integrally formed with the base plate 34. Stud 42 has an aperture transversely disposed therethrough for receiving a pivot pin 44. Stud 42 additionally includes a resiliently compressible member 48, which in the preferred embodiment is a Bellville type spring washer. Resiliently compressible member 48 is disposed between one end of latch arm 14 and the stud pedestal 43. Compressible member 48 has an aperture disposed therein having a diameter greater than the diameter of stud 42, such that when compressible member 48 is placed over stud 42, it abuts stud pedestal 43, thereby preventing rattling or floating of latch arm 14 when it is in the open position. A pivot pin 44 is disposed through the stud aperture and through a pivot pin receiving aperture of the latch arm 14, thereby pivotally connecting the hasp assembly 12 to the staple assembly 30. Staple assembly 30 further includes a laterally projecting portion 36, wherein latch arm 14 abuts laterally projecting portion 36 when latch arm 14 is in the closed position. Latch arm 14 includes a notch 17 disposed adjacent its pivotal end, wherein notch 17 pivots about stud 42 when the latch arm 14 is moved between the open position and the closed position.

Thus, while the present invention has been particularly shown and described with reference to the preferred embodiment above, it will be understood by those skilled in the art that various additional embodiments may be contemplated without departing from the spirit and scope of the present invention.

I claim:

1. An apparatus for preventing access to a battery disconnect switch, comprising:

a hasp assembly, said hasp assembly including a latch arm, said latch arm having a proximal end and a distal end, said latch arm being movable between an open position and a closed position, said latch arm having a staple receiving aperture disposed therethrough adjacent its distal end, said latch arm having a pivot pin receiving aperture disposed transversely therethrough adjacent its proximal end;

a staple assembly pivotally attached to said hasp assembly, said staple assembly including a base member having a proximal end and a distal end, said base member being adapted to be mounted on a support surface, said base member having a switch engagement member aperture disposed therethrough;

a staple extending upwardly from said base member, said staple having an aperture disposed transversely therethrough, said staple being connected to said base member adjacent said base member distal end, said staple being received by and extending through said staple receiving aperture of said latch arm when said latch arm is in the closed position;

a stud extending upwardly from said base member, said stud having an aperture disposed transversely therethrough, said stud being connected to said base member adjacent said base member proximal end;

a pivot pin, said pivot pin disposed through said stud aperture and through said pivot pin receiving aperture of said latch arm, thereby pivotally connecting said hasp assembly to said staple assembly, including a resilient compressure member disposed between said latch arm proximal end and said base member proximal end; wherein said resilient compressible member is a spring-type washer disposed on said stud.

2. An apparatus as recited in claim 1, wherein said staple includes a laterally projecting portion, wherein the latch arm abuts the laterally projecting portion when the hasp assembly and the staple assembly are cooperatively engaging one another.

3. An apparatus as recited in claim 2, wherein said base member includes a pin locator aperture for aligning said base member with the disconnect switch.

4. An apparatus as recited in claim 3 wherein said latch arm includes a notch disposed adjacent its proximal end, said notch pivoting about said stud when said latch arm is moved between the open position and the closed position.

5. An apparatus as recited in claim 1, wherein said base member includes a stud pedestal integrally connected to said base member and to said stud, wherein said resilient compressible member abuts said stud pedestal.

6. An apparatus for preventing access to a battery disconnect switch, comprising:

a hasp assembly, said hasp assembly including a latch arm, said latch arm having a proximal end and a distal end, said latch arm being movable between an open position and a closed position, said latch arm having a staple receiving aperture disposed therethrough adjacent its distal end, said latch arm having a pivot pin receiving aperture disposed transversely therethrough adjacent its proximal end;

a staple assembly pivotally attached to said hasp assembly, said staple assembly including a base member having a proximal end and a distal end, said base member being adapted to be mounted on a support surface, said base member having a switch engagement member aperture disposed therethrough;

a staple extending upwardly from said base member, said staple having an aperture disposed transversely therethrough, said staple being connected to said base member adjacent said base member distal end, said staple being received by and extending through said staple receiving aperture of said latch arm when said latch arm is in the closed position;

a stud integrally connected to and extending upwardly from said base member, said stud having an aperture disposed transversely therethrough, said stud being connected to said base member adjacent said base member proximal end;

a pivot pin, said pivot pin disposed through said stud aperture and through said pivot pin receiving aperture of said latch arm, thereby pivotally connecting said hasp assembly to said staple assembly; and a spring-type washer disposed on said stud;

said latch arm including a notch disposed adjacent its proximal end, said notch pivoting about said stud when said latch arm is moved between the open position and the closed position.

7. An apparatus as recited in claim 6, wherein said staple includes a laterally projecting portion, wherein the latch arm abuts the laterally projecting portion when the hasp assembly and the staple assembly are cooperatively engaging one another.

8. An apparatus as recited in claim 7, wherein said base member includes a pin locator aperture for aligning said base member with the disconnect switch.

9. An apparatus as recited in claim 6, wherein said base member includes a stud pedestal integrally connected to and disposed between said base member and said stud, wherein said spring-type washer abuts said stud pedestal.

* * * * *

UNITED STATES PATENT AND TRADEMARK OFFICE

CERTIFICATE OF CORRECTION

PATENT NO. : 5,732,575

DATED : March 31, 1998

INVENTOR(S) : John R. Kaveney

It is certified that error appears in the above-identified patent and that said Letters Patent is hereby corrected as shown below:

Column 3, line 34, delete "compressure" and insert --compressible--.

Signed and Sealed this

Fourteenth Day of July, 1998

Bruce Lehman

*Attest:*

BRUCE LEHMAN

*Attesting Officer*

*Commissioner of Patents and Trademarks*